US007147768B2

(12) United States Patent
Breault

(10) Patent No.: US 7,147,768 B2
(45) Date of Patent: Dec. 12, 2006

(54) ELECTROCHEMICAL SCALE INHIBITION

(75) Inventor: Raymond Breault, Jonquiere (CA)

(73) Assignee: Alcan International Limited, Montreal (CA)

( * ) Notice: Subject to any disclaimer, the term of this patent is extended or adjusted under 35 U.S.C. 154(b) by 433 days.

(21) Appl. No.: 10/222,631

(22) Filed: Aug. 15, 2002

(65) Prior Publication Data

US 2004/0031697 A1 Feb. 19, 2004

(51) Int. Cl.
*C23F 13/12* (2006.01)
*C23F 11/06* (2006.01)

(52) U.S. Cl. ..... 205/730; 205/731; 205/735; 205/736; 205/740

(58) Field of Classification Search ..... 205/730, 205/731, 735, 740, 736
See application file for complete search history.

(56) References Cited

U.S. PATENT DOCUMENTS

| | | | | |
|---|---|---|---|---|
| 3,799,797 | A | 3/1974 | Hughes et al. | 117/72 |
| 4,173,523 | A * | 11/1979 | Bastien et al. | 204/196.21 |
| 4,627,900 | A * | 12/1986 | Sherwood et al. | 205/729 |
| 4,731,259 | A | 3/1988 | Lloyd | 427/155 |
| 6,224,742 | B1 * | 5/2001 | Doniguian | 205/724 |

FOREIGN PATENT DOCUMENTS

JP 02-188424 7/1990

OTHER PUBLICATIONS

Steinhagon et al., "Problems and Costs due to Heat Exchanger Fouling . . . ", *Heat Tsfr. Eng'r's*, vol. 14, pp. 19-29 (1993), no month available.

Le et al., "The Electrochemical Behaviour of Pressure Vessel Steel . . . ", *Corrosion Science*, vol. 30, pp. 117-134 (1990), no month available.

Baeckmann et al., Handbuch des Kathodischen Korrosionsschutzes, Basel: Verlag Chemie, 1980, pp. 58-59, 275 364, 371-374.

English translation of JP 02-188424, Jul. 24, 1990, Showa Denko KK (translation only).

Baeckmann et al., Handbuch des Kathodischen Korrosionsschutzes (1980), English translation of pp. 58-59, 275, 364, 371-374 (translation only), no month available.

PCT Written Opinion mailed Aug. 26, 2004 in International Application No. PCT/CA03/01200.

* cited by examiner

*Primary Examiner*—Bruce F. Bell
(74) *Attorney, Agent, or Firm*—Cooper & Dunham LLP

(57) ABSTRACT

A process of reducing scaling of a metal surface exposed to an aqueous solution from which scale may form after a period of exposure. The process comprises applying a cathodic potential to the surface for at least some of the period of exposure. In some cases, e.g. when an article is made of a ferrous metal, it is advantageous to coat the article with a different metal (e.g. copper or an alloy of copper) before applying the cathodic potential to avoid hydrogen generation and excessive current flow. An article to be protected from scaling may also advantageously be electrically isolated from other parts of an apparatus.

31 Claims, 8 Drawing Sheets

ELECTROCHEMICAL SCALE INHIBITION

BACKGROUND OF THE INVENTION

1. Field of the Invention

This invention relates to scale inhibition in industrial and commercial processes and plants. More particularly, it relates to the inhibition of scale formation by electrochemical means intended primarily, but not exclusively, for use in Bayer plants designed for the production of alumina from bauxite.

2. Background Art

The Bayer process is a well-known method of obtaining alumina for aluminum production from bauxite, the principal ore. The Bayer process circuit involves a series of digestion and precipitation steps carried out in a number of vessels that are interconnected by pipes and operated by a series of pumps and valves. Many of the steps of the process involve highly alkaline conditions and elevated temperatures and pressures. A problem that persists in such processes is that, as the process is operated, scale (i.e. a solid deposit that is difficult to remove) tends to form at various points in the apparatus. The scale formed in the Bayer process is usually gibbsite or sodalite (alumino-silicate salts containing sodium carbonate and sodium sulfate in addition to alumina and silica). This build-up of scale reduces the efficiency of the operation and may result in plant shutdown. Periodic scale removal is generally carried out, but this can result in expense and operational delays. For example, it has been calculated that the cost of the production of alumina could be reduced by 5 to 10% if scale formation could be avoided.

In the past, no commercially effective way of avoiding scale formation has been developed and effort has been concentrated instead on methods of scale removal. For example, U.S. Pat. No. 4,731,259 which issued on Mar. 15, 1988 to David J. Lloyd discloses a process for de-scaling surfaces of Bayer process equipment by first cleaning the surfaces and then coating the surfaces with a suitable resin, such as epoxy resin, that is thermosetting upon being cross-linked. The coating is applied in two or more layers and the final layer is one that readily detaches from the base coating when subjected to a high pressure fluid blast. Thus, scale that has built up on such a surface may be removed by high pressure fluid cleaning.

Clearly, even such procedures require a definite cleaning step that may cause delays in processing and even plant shut-down. It would therefore be advantageous to prevent the build up of scale in the first place so that cleaning and de-scaling operations may be avoided entirely, or at least delayed considerably.

SUMMARY OF THE INVENTION

An object of the present invention is to avoid or delay scale formation in industrial and commercial processes, particularly during operation of the Bayer process.

Another object of the invention is to avoid or considerably delay the need for de-scaling operations when operating the Bayer process.

A still further object of the invention is to provide a process of reducing or avoiding scaling of specific items of a plant or apparatus for carrying out an industrial process in which scaling is a problem.

In one aspect, the present invention provides a process of reducing scaling of a metal surface exposed to an aqueous solution from which scale may form after a period of exposure, which process comprises applying a cathodic potential to the surface for at least some of the period of exposure, the cathodic potential being chosen from within a range effective to impart resistance to scaling.

In another aspect, the invention provides a process of protecting an article, made at least in part of a metal, from scaling when the article is exposed to an aqueous solution from which scale may form, which process comprises applying a layer of a metal different from the metal of the article to form a surface of the different metal exposed to the solution, and applying a cathodic potential to the surface of the different metal during at least some of the exposure to the solution, the cathodic potential being chosen from within a range effective to impart resistance to scaling.

The numerical values of the potentials applied to surfaces and articles according to the present invention may be expressed relative to a standard electrode, such as a standard hydrogen electrode (SHE) or standard calomel electrode. The sign of such potentials (negative or positive) is relative to the corrosion potential of the surface or article in a given set of conditions.

The present invention makes it possible to operate industrial and commercial equipment for much longer periods of time without having to carry out de-scaling operations.

While the invention is particularly suitable for reducing scaling during operation of the Bayer process, it may be applied to other commercial and industrial processes in which metal items are in contact with aqueous solutions (especially alkaline aqueous solutions). Examples of such additional industries are those that employ temperatures above ambient and, especially, those that employ water evaporation units (heat exchangers). The dairy industry, for example, faces major fouling of the process equipment, in particular during pasteurization. Another example is the deposition of calcium oxalate scale in the pulp and paper industry. In general, the present invention may be used to prevent the deposition on heat transfer surfaces of inverse solubility salts, e.g. in desalination plants, geothermal energy production plants, sugar factories, etc.

DETAILED DESCRIPTION OF THE INVENTION

Figure 1:
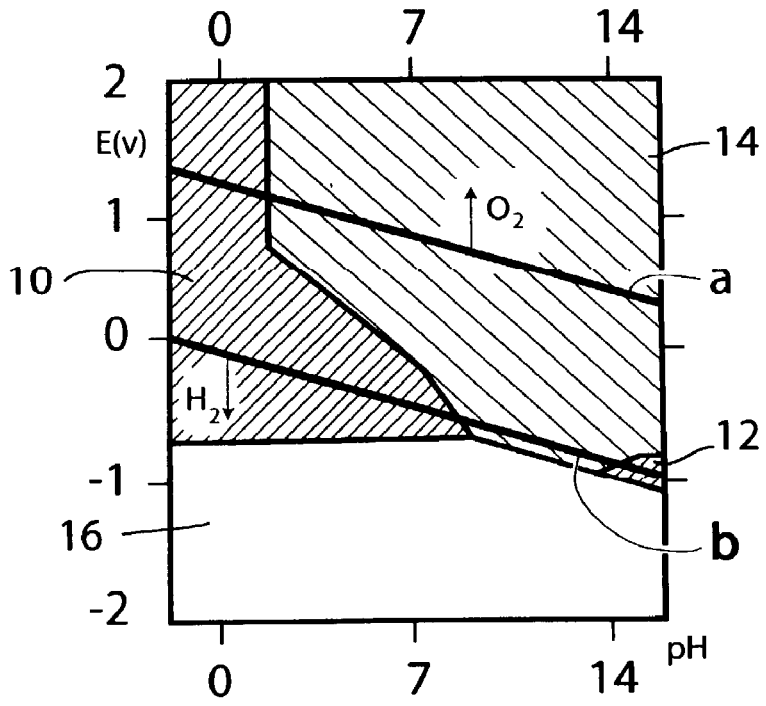
FIG. 1 is a simplified Pourbaix diagram obtained for steel.

The present invention utilizes electrochemical means to prevent or significantly delay the formation of scale in industrial processes, most preferably the Bayer process.

The surface of any metal object, e.g. articles and equipment or specific parts of equipment, used for carrying out the Bayer process (pipes, decanters, heat exchangers, and the like), has a corrosion potential when exposed to an aqueous solution. The corrosion potential depends on the identity of the metal and on the composition (particularly the pH) of the solution. The actual electrical potential of a surface of an object may be varied from the corrosion potential by the imposition of an artificial electrical potential. Two possibilities exist; in the first, the actual potential of the object (i.e. a metallic surface) is made more positive than the corrosion potential, in which case it is referred to as anodic; and in the second, the actual potential is made more negative than the corrosion potential, in which case it is referred to as cathodic. In the present invention, it has unexpectedly been found that scale formation can be significantly reduced or eliminated if the potential of an object used in the Bayer circuit is made cathodic, i.e. more negative than the corrosion potential. This phenomenon is referred to by the inventor of the present invention as scale inhibition by cathodic protection. The invention may employ a constant (fixed) cathodic potential (as in potentiostatic conditions) or, alternatively, a constant (fixed) cathodic current (as in galvanostatic conditions). Preferably, the cathodic potential is kept fixed at a predetermined value and held constant.

Without wishing to be bound by any particular theory, it is believed that the application of a cathodic potential, which operates by making a protected metallic surface more negative than its corrosion potential, is effective because it partly or totally removes the oxide/hydroxide layer normally present on the metallic surface when exposed to an aqueous solution by providing reducing surface conditions. Increasing the cathodic potential and the current density will ensure a more complete removal of the metal oxide/hydroxide layer. The elimination of this metallic oxide/hydroxide layer, present on any metal when in contact with Bayer process liquids, but also with any aqueous solution, prevents the adherence of scale to the surface. However, there may be other mechanisms at play. For example, at a cathodic potential, negative charges are accumulated at the metal/solution interface and the negative aluminate ions present in Bayer process liquids may be driven away from the surface by charge repulsion, thus preventing the formation of scale.

When a metal surface becomes oxidized in an aqueous solution, hydroxyl groups are present at the surface of the oxide layer. The adherence of scale to the surface in Bayer process conditions can be seen as a chemical reaction, as follows:

$$\text{Metal-OH}+\text{Al(HO)}_3 \leftrightarrow \text{Metal-O-Al(OH)}_2+\text{H}_2\text{O}$$

This is a reaction that applies to the formation of both sodalite and gibbsite scale, although in the case of sodalite scale, the chemical bond may also involve silicon atoms. Consequently, if such an oxide layer is not present, aluminum-containing species will not attach themselves to the surface by this reaction. This means that the cathodic potential or current applied to the article to be protected from scale will move the surface potential of the article into a region in which there is immunity to oxide formation.

Depending on the metal at the surface and the cathodic potential applied to the surface, water in the aqueous solution may be electrochemically decomposed (electrolysed) to form hydrogen at the metal surface (the cathode). In the case of some metals and hard alloys, this may be undesirable because the generation of hydrogen can result in embrittlement of the metal at the surface intended to be protected from scale deposition, and this can cause eventual failure of the equipment. Preferably, therefore, the cathodic potential applied to the surfaces of such metals should be such that hydrogen generation is avoided or minimized, at least when such possible embrittlement is likely to be of concern. In the case of some metals, such as mild steel, however, hydrogen embrittlement is not normally a problem and hydrogen generation is less of a concern in this case, provided the generated gas can be accommodated in the process and provided the current flow does not become excessive. Additionally, the extent of current flow is of concern because it may exceed the capacity of the power supply, particularly when the solution in contact with the metal surface is highly electrically conductive, as is the case for the Bayer process conditions.

The extent of hydrogen generation will depend on the type of metal and the hydrogen overpotential at the metal surface, i.e. the potential in excess of the theoretical potential that is required to produce hydrogen gas in actual conditions. If significant amounts of hydrogen gas are generated, a cathodic protection may still be applied (if embrittlement is not a concern) provided the area of the surface to be protected is relatively small, otherwise the current will become too high to be practical and the amounts of hydrogen generated may cause problems of safety and disposal. For example, a typical heat exchanger made of mild steel used in the Bayer process has 386 tubes each of 3.175 cm (1.25 inch) in diameter and 6.4 m (21 feet) in length, and the resultant surface areas would create much too high a current flow if the cathodic potential were applied in the hydrogen generation region. On the other hand, the seat of a valve made of steel may be cathodically protected at a potential implying significant hydrogen generation, by electrically isolating the valve seat from the remainder of the apparatus by means of current insulators, so that the current required to protect the valve seat may be in the range of 7 amperes at a voltage of 4–5 volts. This would consume only 35 watts, and the resultant hydrogen evolved could be easily handled.

For some metals, there may only be a small range of cathodic potentials that result in both immunity from oxide formation and avoidance of significant hydrogen formation. In fact, it is theoretically possible that for some metals, or process conditions, there may be no such range of cathodic potentials at all, but still the hydrogen evolution may be limited by operating within the hydrogen overpotential needed to generate significant hydrogen evolution in practice. For ferrous metals, and particularly mild steel, the range of such cathodic potentials is small, so hydrogen evolution is almost inevitable. For other metals, notably copper, the range of such potentials is larger, and so it is easier to protect surfaces made of such materials from scale while also avoiding significant hydrogen formation. Most equipment used for the Bayer process is currently made from steel (normally mild steel), but providing a coating of another more suitable metal, such as copper, is an option in order to limit current flow and hydrogen evolution. Copper also has a high heat exchange coefficient, and is therefore desirable for use with items such as heat exchangers.

The optimal working conditions for any particular metal can be obtained using Pourbaix diagrams or calculations (see Marcel Pourbaix, "Atlas of Electrochemical Equilibria in Aqueous Solutions", Second Edition, 1974, National Association of Corrosion Engineers, the disclosure of which is incorporated herein by reference). Such diagrams and calculations allow the effective range of the cathodic potential or cathodic current to be determined for particular materials and conditions. All the results obtained in Bayer liquor, spent or pregnant, clearly show that when a sufficiently high cathodic current is flowing through a mild steel surface, no scale will adhere to the surface. However, the current density, defined as the current flowing through a unit surface area, will vary according to the working conditions.

FIG. 1 is a simplified Pourbaix diagram for steel (i.e. a Potential-pH equilibrium diagram for iron-water at 25° C.) showing potential (E(v)) versus solution pH. As shown, the Pourbaix diagram defines four zones. These consist of two regions 10 and 12 where iron will corrode, a region 14 where a passivation layer can form, and a region 16 which is an immunity region where iron will be stable in the zero oxidation state. Line a represents the potentials at which water decomposition by oxygen formation commences and line b represents the potentials at which water decomposition by hydrogen generation commences. Water is therefore stable in the regions between lines a and b. The conditions needed to prevent scaling are those found in the immunity region 16. To reach this region, the surface potential of the steel must be modified cathodically since, under the Bayer process conditions, the corrosion potential (in this case −0.875 mV) will be in the corrosion region, not in the immunity region. Nevertheless, corrosion of mild steel is prevented because the reaction is minimized by the oxide/hydroxide passivating film on the surface. The shift of the potential, under Bayer plant conditions, can be achieved by means of a potentiostat or a direct current rectifier connected to the article to be protected (see the later description of such units).

Of course, while the Pourbaix diagrams obtained at standard temperature and pressure are of significance, it is the potentials that are obtained under the working conditions of the equipment to be protected that are controlling. Variations in temperature will affect the various regions. For example, the concentration of iron hydroxides on a surface will be reduced at high temperature. Pressure will also have an effect on the equilibrium of any gaseous species present. Essentially, the water stability will be different and lines a and b on the Pourbaix diagrams of the accompanying drawings represent water stability only for 1 atmosphere pressure. These diagrams are therefore only useful as guides and empirical values may be obtained from experiments carried out under working conditions. In fact, the different regions for iron (for example) may be verified experimentally by potentiokinetic experiments under conditions likely to be encountered during use.

Figure 2:
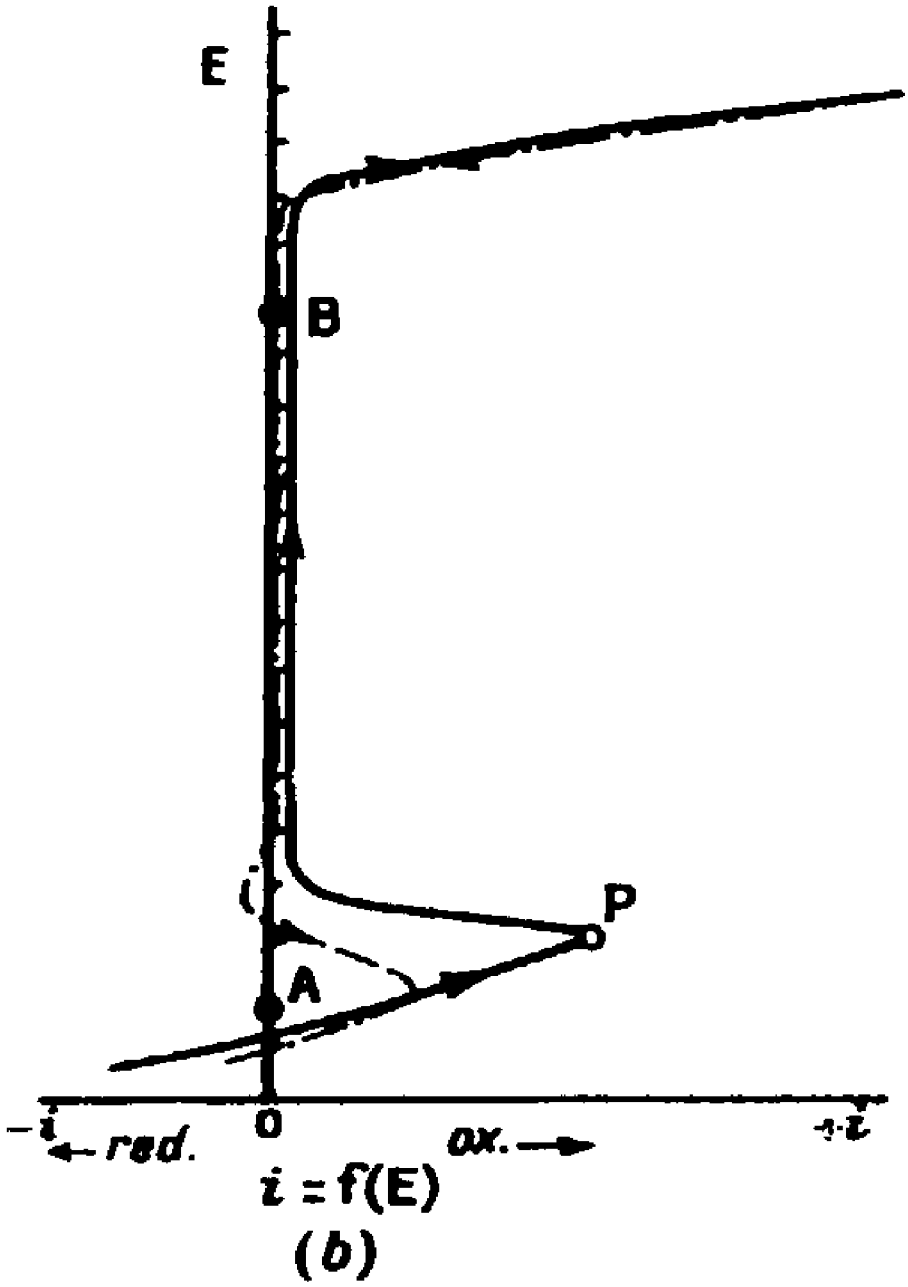
FIG. 2 is a typical scan produced by a potentiokinetic method which may be used in conjunction with the present invention.

The presence of different domains can be verified experimentally by different electrochemical experiments. One such experiment is the so-called "potentiokinetic method." A potentiokinetic experiment may be conducted in a standard three electrode electrochemical cell consisting of a working electrode, an auxiliary (counter) electrode and a reference electrode. The working electrode may be made from a sample of the metal under study, the auxiliary electrode is normally made of platinum for laboratory studies (it should be relatively inert and not cause any contamination of the solution, if dissolved), and the reference electrode may be a saturated calomel electrode or a silver/silver chloride electrode. A potentiostat is used to provide a direct current maintained at a pre-determined voltage, measured between the working electrode and the reference electrode, independently of the current flowing between the working electrode and the auxiliary electrode or any other changes that may occur at the auxiliary electrode. A range of potentials is scanned, step-by-step, and the current flowing through the working electrode is measured. A typical result for iron is shown in FIG. 2 (which shows the polarization curve for iron in a 0.10 M $NaHCO_3$ solution (at pH 8.4) obtained by the potentiokinetic method). The x-axis of this graph is the measured current and the y-axis is the applied potential. The negative current values correspond to a reduction current, meaning that a reduction reaction is occurring. In this case, it is the hydrogen evolution reaction. In this example, positive values represent an anodic current. For an iron working electrode, it is the iron that is oxidized and the reactions involved are as follows:

$$Fe \leftrightarrow Fe^{++} + 2e^-$$

$$Fe^{++} + 2H_2O \leftrightarrow HFeO_2^- + 3H^+$$

These reactions are responsible for the increased anodic current until point P on the curve is reached. At that point, the solution at the surface is saturated with ionic species and an oxide/hydroxide film starts to form on the metallic surface. As the thickness of the film increases, the dissolution rate drops and a reduction of the anodic current is observed past point P. When the film is highly protective, the surface is in the passivation region. As the potential is shifted to more positive values, the point is reached where the oxidation of water is possible (point B in the Figure). Proceeding to more positive values will overcome the oxygen evolution overpotential and the anodic current will increase again. These types of experiments clearly show the three different zones for iron: the immunity region, at potentials where a cathodic current is flowing, the corrosion region where the anodic current is significant (around point P on the curve) and the passivation region, where there is a low anodic current for a significant range of potentials.

Another method for determining suitable cathodic potentials is to produce a cyclic voltamogram. A cyclic voltamogram is obtained by scanning back and forth over a potential range. During these scans, the current will vary depending on the surface reactions, surface species, etc. Current peaks will be observed at certain potentials. From these peaks, surface reactions can be deduced and also the formation of specific surface metallic oxides may be assumed. This type of experimental result provides information on the surface conditions and the potential needed to provide a cathodic current. It also shows how the cathodic current changes with a shift of potential. More information about cyclic voltamograms may be obtained from Le, H. H. and Ghali, E.: Corrosion Science, 1990, 30, 117–134, the disclosure of which is incorporated herein by reference.

As mentioned above, a problem that may be encountered with iron and ferrous metals is that the immunity region does not always overlap the water stability region, as is the case for copper. Water will not decompose at the electrodes when the potential of the electrodes is located between the lines a and b on the diagram of FIG. 1. Thus, if the potential is made more cathodic than line b for a specified pH, hydrogen will be generated according to the following equation:

$$2H_2O + 2e^- \leftrightarrow H_2 + 2OH^-$$

The amount of current required to move the potential into the immunity domain for steel will depend on the process conditions, although increasing the current density will ensure a more complete removal of the metal oxide/hydroxide layer. In some cases, where there is no concern about hydrogen embrittlement and where the hydrogen generated can be safely handled within the process, scale control by cathodic protection can be used to prevent scaling. Also, it is important to note that the water stability region can be extended with pressure and, if the pressure is suitably adjusted, the water stability region can be extended sufficiently to overlap the immunity region of iron. However, it may be difficult or impossible to modify the pressure at a surface when attempting to protect an object forming part of a chemical treatment plant because the desired chemical process may dictate the pressure at any point in the plant.

Other parameters can also affect the current required, namely dissolved oxygen, temperature or the presence of oxidizing impurities. Therefore, the optimal current density depends on the process parameters.

Figure 3:
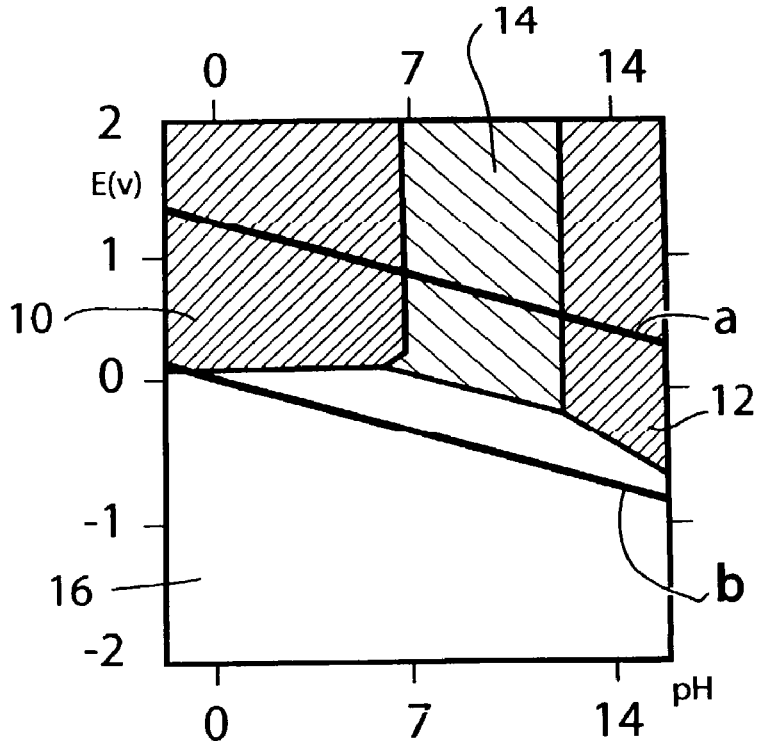
FIG. 3 is a simplified Pourbaix diagram obtained for copper.

As discussed, a metal that is much easier to protect cathodically than iron is copper. The simplified Pourbaix diagram for copper is shown in FIG. 3. This shows the Potential-pH equilibrium diagram for the system copper-water at 25° C., and shows the domains of corrosion (regions 10 and 12), immunity (region 16) and possible passivation (region 14) of copper at 25° C. and atmospheric pressure. From FIG. 3, it can be seen that the immunity domain 16 of copper overlaps the stability domain of water (between lines a and b), thus copper can be made more immune by a cathodic shift of its potential without the electro-decomposition of water. Scaling can thus be prevented on copper by cathodic protection at very low current density since all the cathodic current will be used to reduce the oxidizing solution species, dissolved oxygen for example, without reducing water to generated hydrogen.

This means that critical parts of the Bayer apparatus of large surface area, such as heat exchanger tubes and tube sheets or bundles, may advantageously be made of copper or coated with copper to facilitate cathodic protection after electrical insulation of the tube bundle from the rest of the heat exchanger body. Parts may be coated with copper by any suitable means, for example plasma spraying or flame spraying of copper onto a steel base. Such processes may be used to protect existing equipment without undue difficulty. Electrochemical deposition of copper may alternatively be employed, or any other coating process. In such processes, there is no specific minimum coating thickness that has to be provided. In fact, complete coverage with copper may not even be necessary. Copper provides a better protection at low current and a low hydrogen evolution rate. As more and more steel is exposed, the current will increase to a point where the power supply will reach its maximum capacity.

Copper alloys are also effective for forming such coatings, e.g. inhibited admiralty metal (C44300, C44400 and C44500), aluminum bronzes and copper nickels (C70600 and C71500). It is fortunate that copper is rated good to very good (e.g. according to the Handbook of Corrosion by Pierre R. Roberge) for use in sodium hydroxide solutions (used in the Bayer process), depending on the alloy selected. For example, C1100 (which is more than 90% by weight copper) is very good. Copper nickel 30% (C71500) in sodium hydroxide is rated as excellent and there is little or no corrosion.

While copper and copper alloys are preferred coating materials to reduce the cathodic current, it is possible to use other metals, e.g. lead, cobalt, silver, gold and rhodium. Nickel may also be used, but is less advantageous because, at high pH values, it does not have a common area with the water stability region, but if the hydrogen evolution overpotential on nickel is high, it may be used in the same way as steel. In practice, any metal or metal alloy can be used when the cathodic current can be made high enough to reduce its oxide/hydroxide layer, or prevent the oxide/hydroxide layer from forming under the process conditions if previously by other surface treatments. For example, chromium or an alloy containing chromium (monel or stainless steel) can be prevented from scaling by applying a high cathodic current, as is the case for mild steel.

Theoretically, any cathodic potential more negative than the corrosion potential under the working conditions will be effective in the present invention. As a practical matter, under process conditions, a potential at a more cathodic (negative) value than −100 mV is preferably applied. Optimally, the applied cathodic potential is between −500 mV and −800 mV. For the protection of mild steel under Bayer process conditions, a constant current density is more practical than a constant potential. For example, it has been shown that scale control may be carried out on mild steel at a current density of 28.5 mA/square inch. The potential and current may be applied continuously or in pulse mode.

Even if no current density optimization has been carried out, critical parts of a plant can be prevented from scaling, e.g. live steam heat exchanger exit valves. In this particular case, it is the seat of the valve that causes a problem when it is scaled. Scale can be prevented sufficiently by first electrically insulating (isolating) the seat from the other parts of the plant and then applying a current of approximately 7 amperes.

Another specific application of the present invention is to the portion of the line in a Bayer process plant going from the live steam heat exchangers to the digesters which normally scale quite heavily. Critical measuring instruments can also be prevented from scaling using the process of the present invention.

As noted above, the negative potential or current may be applied to specific apparatus by connecting the apparatus to a potentiostat/galvanostat (see Stansbury, G., and Buchanan, Ray: *Fundamentals of Electrochemical Corrosion*; First Edition, 2000; the disclosure of which is incorporated herein by reference). Such a device forms a direct current power supply and, in fact, once the preferred conditions are known, a very simple current rectifier may be used. Suitable potentiostats/galvanostats are available from many suppliers (e.g. model 273 from EG&G Princeton Applied Research, P.O. Box 2565, Princeton, N.J., 08543-2565, USA, or model SRC-4 and model SRC-255 supplied by Cathodic Technology Ltd., 10 McEwan Drive, Unit 4, Bolton, Ontario, Canada, L7E 1H1). In a potentiostatic mode, a fixed potential, from a set point value measured between a working electrode and a reference electrode, is supplied at the working electrode, independently of what happens between the working electrode and an auxiliary electrode even if the current changes. When a cathodic potential is applied, the potential will remain constant and a cathodic current will vary as a function of the electrode area, anode type, secondary reactions, etc. In galvanostatic mode, a fixed direct current is maintained at the working electrode, and the applied potential changes to ensure that the current is kept constant.

Figure 4:
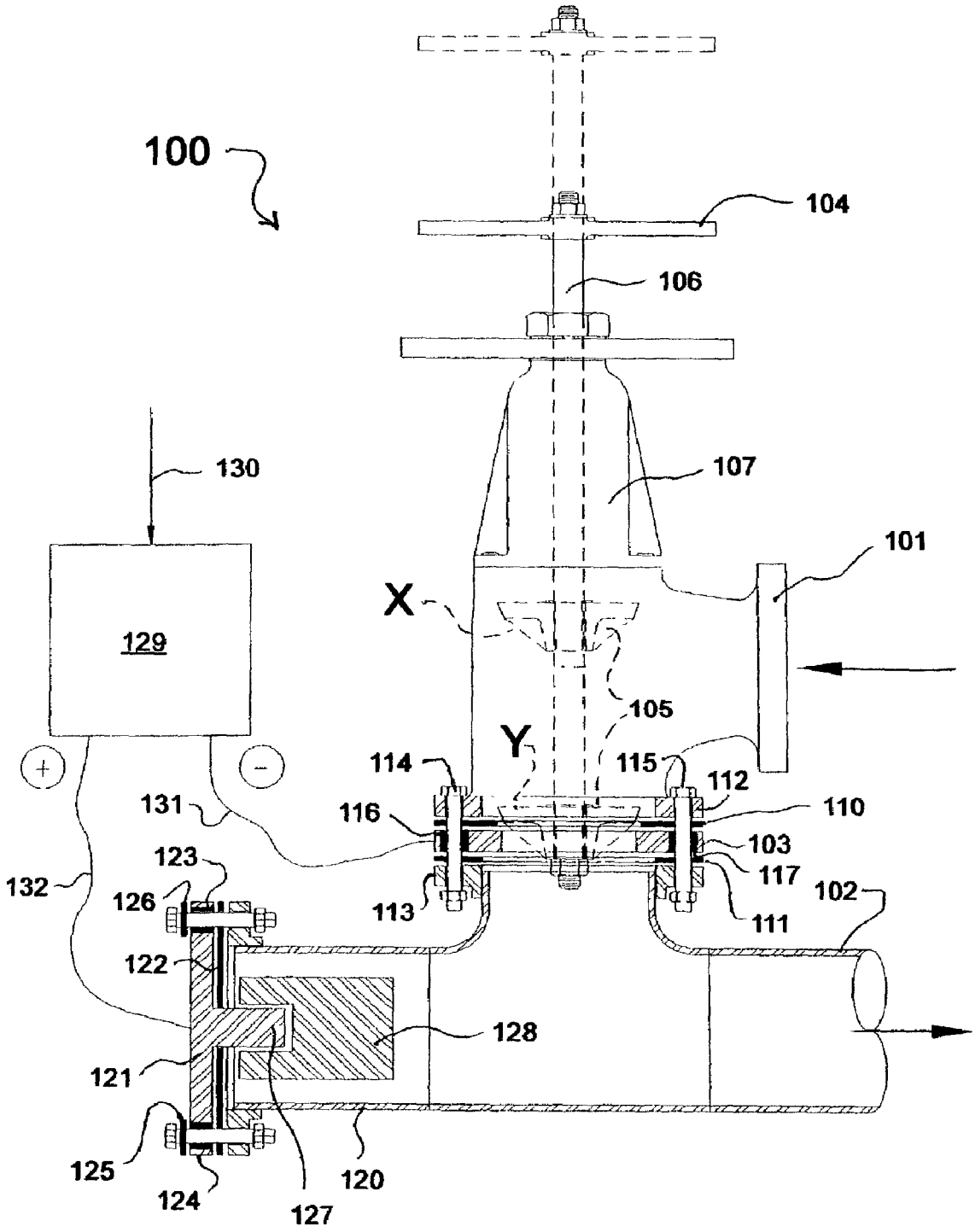
FIG. 4 is a cross-section of an angle valve (with slightly separated joints) showing an example of how the present invention may be applied in practice.
Figure 5:
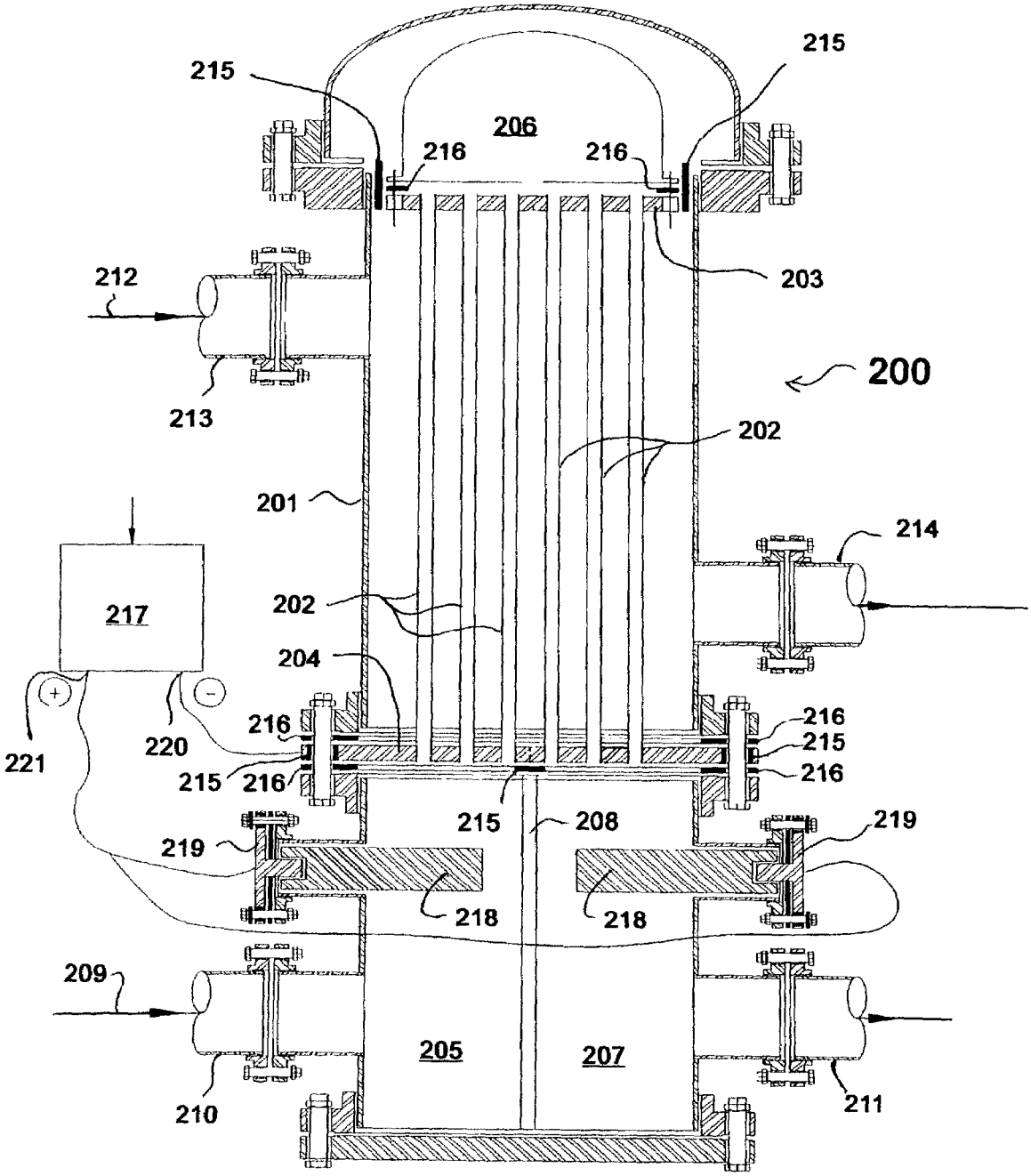
FIG. 5 is a cross-section of a heat exchanger unit (with slightly separated joints) showing an example of how the present invention may be applied in practice.

FIGS. 4 and 5 show practical applications of the present invention.

FIG. 4 is a cross-section of a screw-type angle valve 100 of the type used in industrial apparatus for reducing or shutting-off a flow of liquid through a pipe. This is the type of valve typically located between a heat exchanger and digester of a Bayer digestion plant. Liquid enters the valve through coupling 101 and leaves through pipe 102 after passing through annular valve seat 103. A valve body 105 is movable between an uppermost position X and a lowermost position Y by means of a manually operable wheel 104 which is fixed to a screw-threaded shaft 106 passing through a screw-threaded housing 107. The shaft 106 is connected at its lower end to the valve body 105. Rotation of the wheel in one direction of another moves the valve body 105 between positions X and Y to open or close the valve.

The valve seat 103 is made of, or coated with, a metal of the type referred to above and it is electrically insulated from the remainder of the apparatus by means of sealing rings 110 and 111 made of electrically insulating material (e.g. rubber or synthetic elastomer) positioned between the valve seat 103 and the adjacent couplings 112 and 113. The arrangement is seated and held in place by bolts 114, 115 which pass through holes in the couplings and valve seat. Where the bolts pass through the valve seat, insulating sleeves 116, 117 surround the bolts to isolate the valve seat from the adjacent metal parts of the bolts. The valve body 105 itself is made of, or coated with, an electrically insulating material (not shown) at least where it contacts the valve seat 103.

The pipe 102 is provided with a short rearward extension 120 closed by a cover plate 121 which is also electrically isolated from the remainder of the apparatus by a flexible sealing element 122, insulating sleeves 123 and 124 and insulating washers 125 and 126. The cover plate 121 has a central projection 127 which extends into the rearward pipe extension 120 and supports a metal anode block 128. The block 128 is held out of contact with the sides of the pipe extension to avoid electrical contact.

An electrical rectifier 129 is supplied with electricity via an electrical lead 130. A negative electrode 131 of the rectifier is electrically connected to the valve seat 103 and a positive electrode 132 is electrically connected to the cover plate 121 and hence the anode block 128. In this way, a cathodic potential is applied to the valve seat where scale formation is normally a problem. The potential applied to the valve seat can be controlled by adjustment of controls of the rectifier and should be adjusted in accordance with the above discussion.

The electrical isolation of the valve seat and anode block avoids excessive current flow and power consumption of the arrangement and allows the protection from scaling to be applied specifically to the part where scaling is normally a significant problem.

FIG. 5 is a vertical cross-section of a heat exchanger unit 200 of the type used in a Bayer digestion plant. The unit consists of an upright tubular body 201 containing an assembly of upright liquid-conveying tubes 202 mounted in tube plates 203 and 204 at their upper and lower ends, respectively. The tubes provide fluid communication between a lower fluid inlet chamber 205, and upper return chamber 206 and a lower fluid outlet chamber 207. Lower fluid inlet chamber 205 and lower fluid outlet chamber 207 and separated by dividing wall 208. Liquid 209, e.g. Bayer liquor, enters the lower fluid inlet chamber 205 through pipe 210, passes through one group of the tubes 202 to the return chamber 206, then from the return chamber through another group of the tubes 202 to the lower fluid outlet chamber 207, and then exits the unit through an outlet pipe 211. A heating medium 212, e.g. steam, enters the tubular body 201 from an upper pipe 213 positioned between tube plates 203 and 204, and exits the tubular body 201 through lower pipe 214 (as condensate, in the case of steam). The heating medium flows around the outer surfaces of the tubes 202 and exchanges heat with the liquid flowing through the tubes.

In this case, the tubes 202 and tube plates 203 and 204 are electrically insulated from the remainder of the apparatus by electrically insulating seals 215 and sleeves 216. The lower tube plate is connected to negative terminal 220 of a rectifier 217 in order to impose a cathodic potential to the tube plates 203, 204 and tubes 202. Anode blocks 218 project into the lower fluid inlet chamber 205 and the lower fluid outlet chamber 207, the anode blocks being supported by electrically isolated cover plates 219 of the type described with reference to FIG. 4. The cover plates 219 are electrically connected to a positive terminal 221 of a rectifier to impose a positive potential. As in the embodiment of FIG. 4, the electrical isolation of the part of the apparatus to be protected from scale (the tube plates 203, 204 and the tubes 202) as well as the anodes 218 limits the electrical current flowing through the heat exchanger unit and allows the protection from scale to be limited to the items most likely to encounter scale deposition. The cathodic potential can be adjusted in accordance with the discussion above to provide maximum protection from scale while minimizing undesirable effects, such as excessive hydrogen generation and power consumption.

The present invention is illustrated in more detail by reference to the following Examples, which are not intended to limit the scope of the invention.

EXAMPLE 1

In this Example, quantitative results demonstrating that cathodic protection or cathodic current can prevent scaling of a steel surface in Bayer process conditions are presented.

Figure 6:
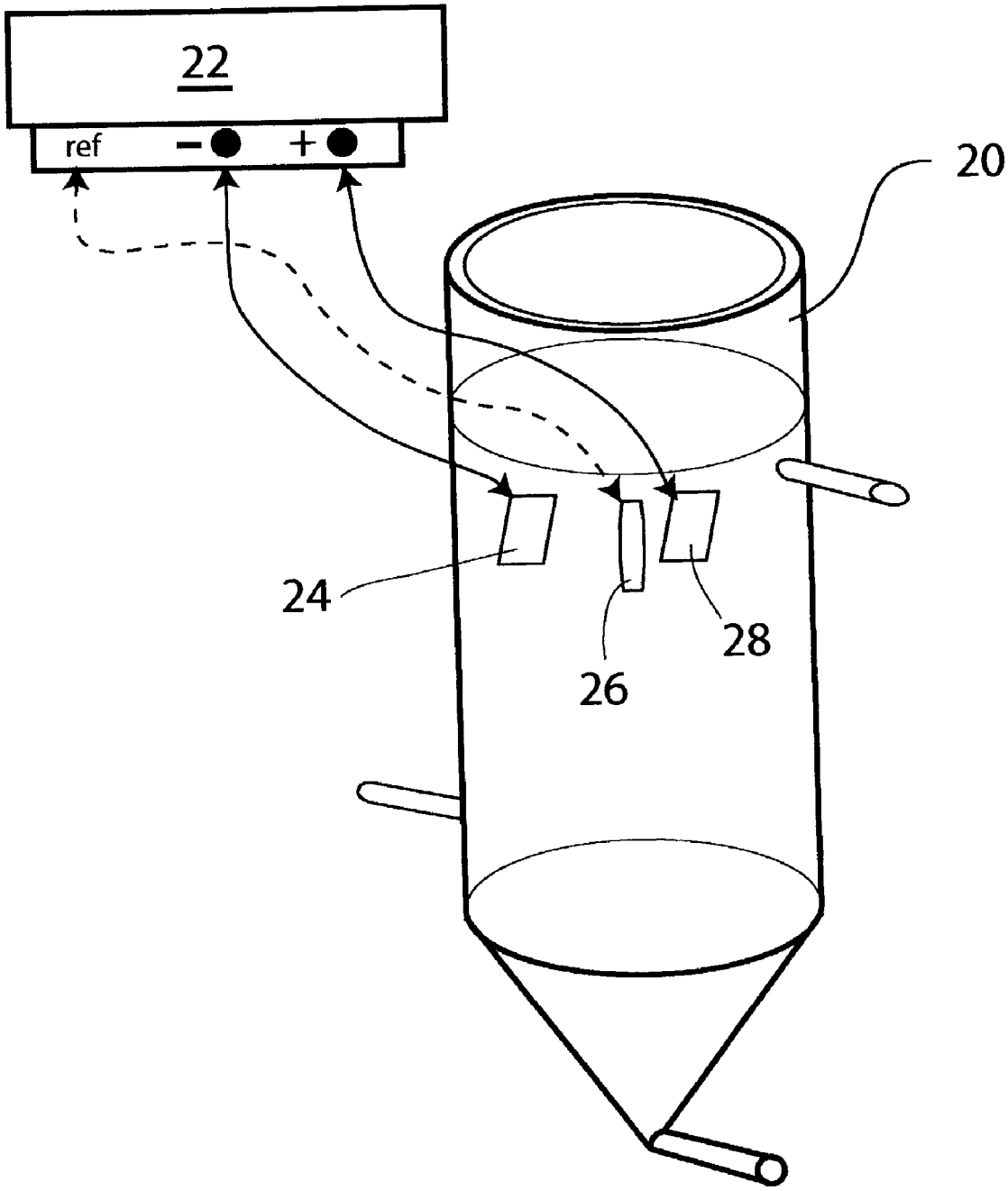
FIG. 6 is a diagram of apparatus that may be used in connection with experiments relating to the present invention.

Referring to FIG. 6, square coupons (16 square inches) of mild steel (44 W) were submerged directly in a high rate decanter 20 (apparatus in use in the Bayer process in the Assignee's Bayer plant) and their weight changes, due to scaling, was followed for up to 350 hours.

Prior to the experiments, the coupons had been sand blasted to remove the oxide layer formed during the hot lamination of steel sheets. The coupons were then submitted to a chemical polishing by submerging the coupons in a solution of 60% by volume $H_3PO_4$, 20% by volume $HNO_3$, and 20% by volume $H_2SO_4$ for 30 minutes at 85° C. The coupons were subjected to the following experiment immediately after the chemical polishing. An electrochemical polishing treatment could also be applied prior to cathodic protection.

Coupons intended for a comparative test involving the use of anodic potentials were pre-oxidized by the generation of an anodic current (0.5 A) for 24 hours for each side in a caustic solution (135 g of NaOH per liter) intended to generate a controlled oxide layer (pre-oxidized coupon provided for comparison purposes).

A potentiostat/galvanostat direct current power supply 22 (EG&R PAR Model 273) was used to polarize a coupon 24 forming a working electrode. A saturated calomel electrode 26 was used as the reference electrode and another steel coupon was used as the auxiliary electrode 28.

Figure 7:
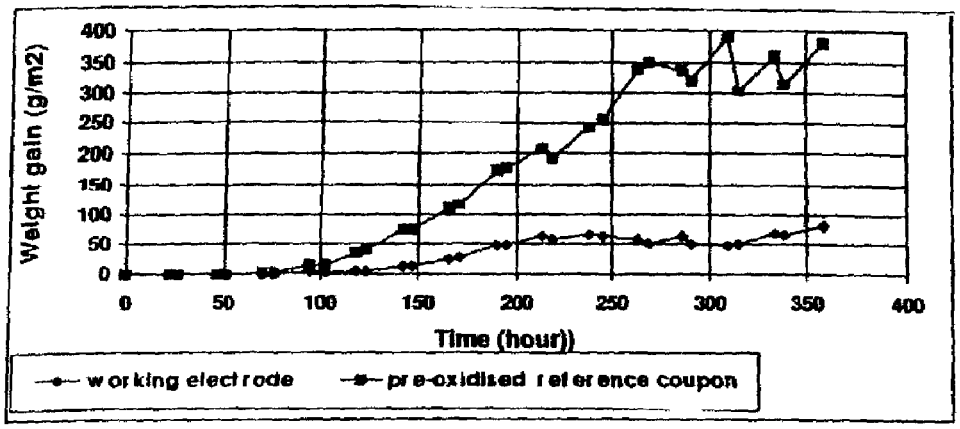
FIGS. 7 to 9 are graphs obtained according to the procedure of Example 1.

FIG. 7 of the accompanying drawings shows the results obtained when a cathodic potential was applied to the steel coupon, compared to a preoxidized coupon, for a period of 350 hours in a high rate decanter where the temperature was about 100° C.

This figure clearly shows that the weight of the cathodically protected steel coupon increases much less than the non-protected coupon. In fact, the weight was essentially constant for some 150 hours, after a slight initial weight increase. On the contrary, the pre-oxidized coupon constantly gained weight, showing a high adherence of the scale on the oxidized surface.

Figure 8:
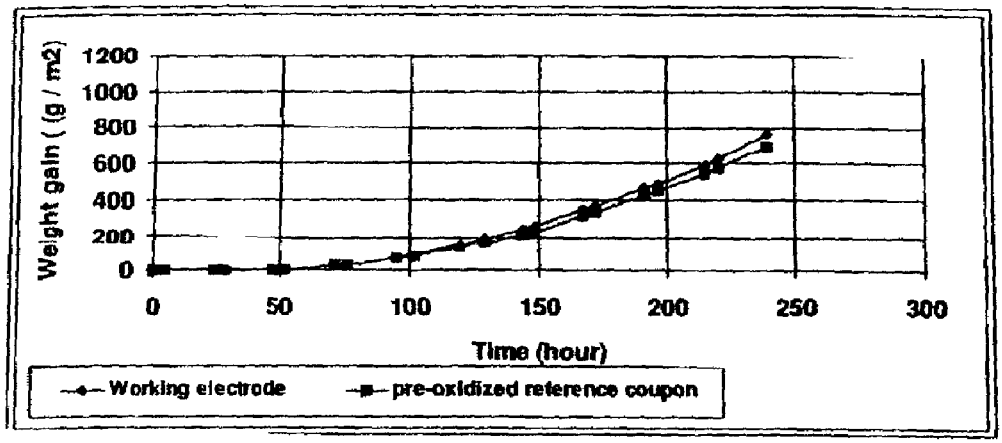

FIG. 8 of the accompanying drawings shows the results obtained when anodic potential was applied to a pre-oxidized coupon. From this figure, it can clearly be seen that when an oxide film is present on a steel surface, scaling will form at a same rate with or without anodic potential applied on the steel coupon.

Figure 9:
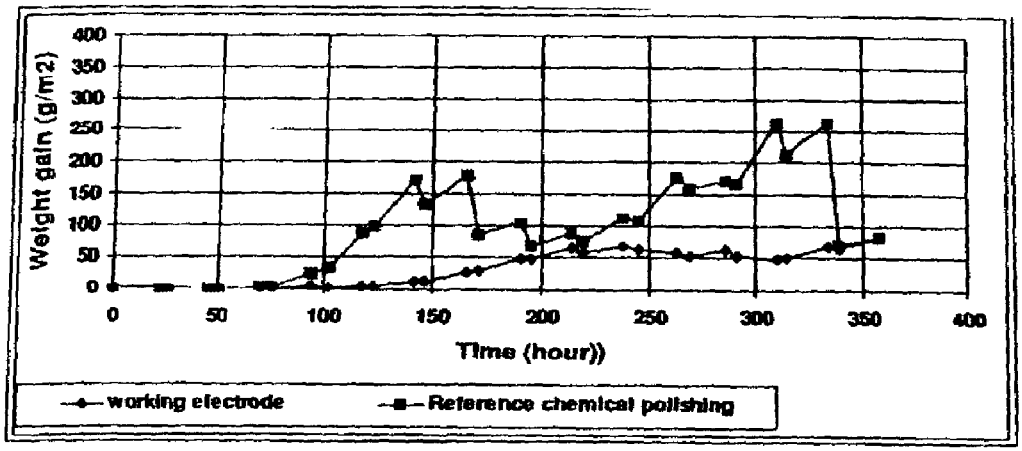

FIG. 9 of the accompanying drawings shows the effect of a cathodic potential on the scaling rate as compared with that of a steel coupon on which no oxide film was initially present (here both the steel coupons were sand blasted and chemically polished).

Tests also show that when the steel surface is only partially covered with an oxide layer, scale will form, but it will adhere much less strongly than on a surface where an oxide film is evenly covering the surface. However, in practice, steel surfaces will always be covered with an oxide layer.

EXAMPLE 2

An experiment was carried out to investigate the scaling of a mild steel probe (7.62 cm (three inches) in length and 2.54 cm (one inch) in diameter) inserted into an exit pipe of a live steam heat exchanger (Exchanger 33 of Ore Plant 1 of the Assignee's Vaudreuil Works) at a point where the probe would come into contact with spent liquor at a temperature of 155° C. and extensive scaling with sodalite would normally take place. Under normal operating conditions, the heat exchanger tubes are scaled within four days of operation and scale removal with acid cleaning (10% by volume sulphuric acid).

The probe was connected to one terminal of a current rectifier and the other terminal was connected to a valve seat of a line to a digester in order to complete the circuit.

Three types of test were carried out, i.e. one involving a cathodic current, one involving an anodic current and the third with no current. When a current was employed, it had a magnitude of 0.8 Amperes. The tests were carried out for four to five days.

The results were that when a cathodic current was flowing through the probe, no sodalite scale was deposited, even after four days. An experiment carried out with no current produced a probe that was significantly scaled. An experiment carried out with an anodic current flowing through the probe produced a probe that was the most scaled of all. The experiment with the cathodic current was repeated and the same result was obtained.

These results obtained with an applied current were very much the same as those obtained with gibbsite scaling, i.e. at 107° C. in pregnant Bayer liquor.

EXAMPLE 3

To compare the effects of a cathodic current on copper and on mild steel, two sets of experiments were conducted simultaneously in a high rate decanter in the Assignee's Vaudreuil works so that both the effect of a cathodic current and the effect of the substrate could be tested under the same experimental conditions. In a high rate decanter 20 (see FIG. 10) the pregnant Bayer liquor had a temperature of 107° C., a NaOH concentration of 3.6 M, a $Na_2CO_3$ concentration of 0.32 M and approximately 1.5 M of dissolved alumina ($Al_2O_3$). As under those conditions the equilibrium concentration of dissolved alumina is around 1.24 M, the experiment was carried out under supersaturated conditions for gibbsite precipitation.

Prior to the experiments, all four coupons were sand blasted to produce a comparable surface preparation.

Figure 10:
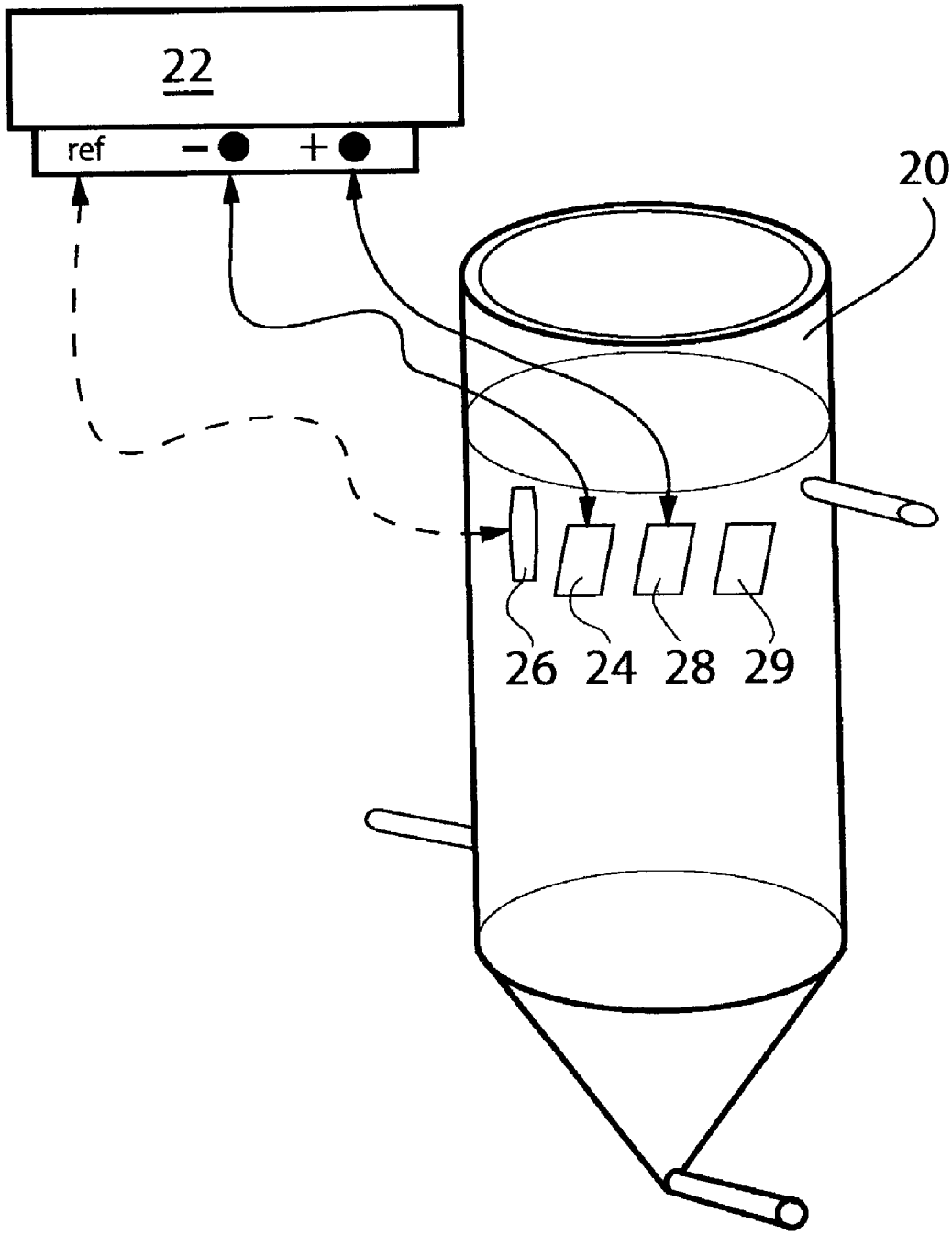
FIG. 10 is a diagram of an apparatus used in Example 3.

The experimental set-up was as shown on FIG. 10. In the case of the copper test, there was one copper reference coupon 29 and one copper coupon 24 that was connected to the negative pole (the cathode) of a galvanostat 22 (similar to the one used in Example 1). To complete the electrical circuit, a mild steel anode 28 was used since the anode material has no effect on the experiment as long as it is stable. A silver/saturated silver chloride (Ag/AgCl) reference electrode 26 was used with the galvanostat. For some experiments, only a direct current rectifier (Hewlett-Packard 6031A, (0–20 V; 0–10 A; 1000 W) was used. In that case, no Ag/AgCl reference electrode was needed.

To follow the weight variation with time, at approximately every 24 hours, the coupons were taken out of the decanter, washed with running water to remove any loose material, dried with acetone and weighed. Then the coupon were put back in the decanter and the current turned back on.

Figure 11:
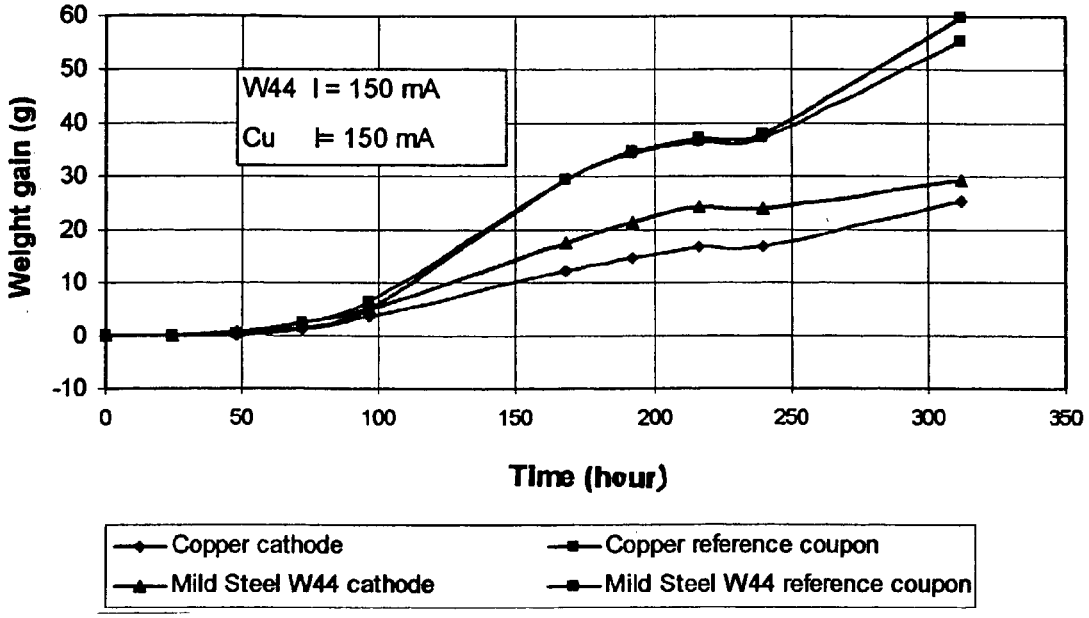
FIGS. 11 and 12 are graphs obtained according to the procedure of Example 3.
Figure 12:
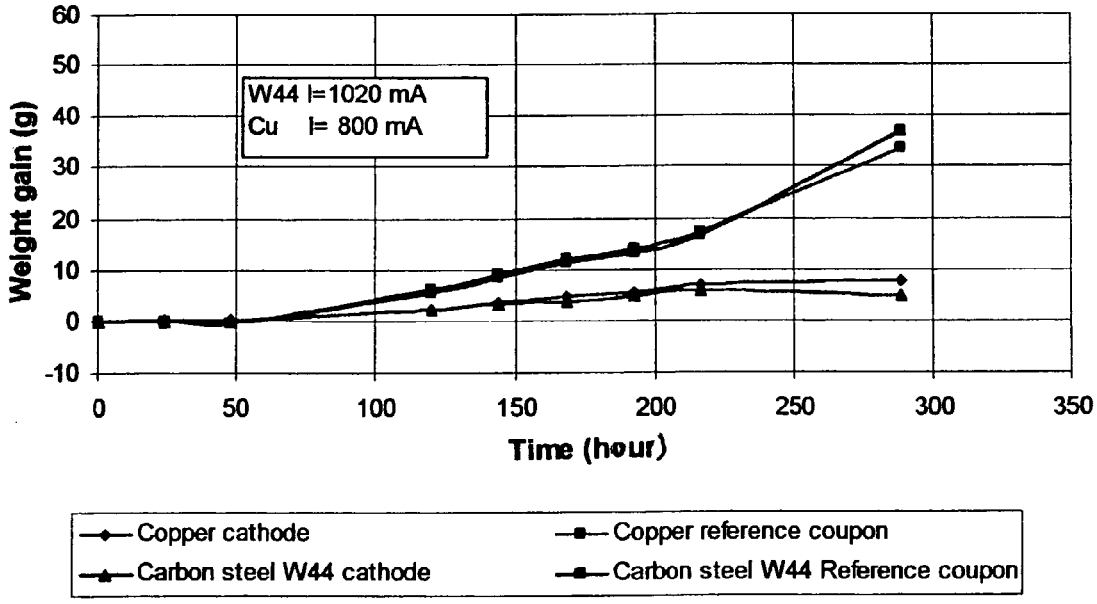

To test the effect of the current density, two currents were used: 150 mA and 800 mA. The results of the 150 mA test are shown in FIG. 11 and the results of the 800 mA test are shown in FIG. 12.

I claim:

1. A process of reducing scaling of a metal surface exposed to an alkaline aqueous solution from which scale may form after a period of exposure, wherein said surface forms part of a layer of metal overlying a body of a different metal, which process comprises applying a cathodic potential to said surface for at least some of said period of exposure, said cathodic potential being chosen from within a range effective to impart resistance to scaling.

2. The process of claim 1, wherein said applied cathodic potential is insufficient to cause substantial electrochemical decomposition of water.

3. The process of claim 1, wherein said applied cathodic potential is sufficient to cause decomposition of water on a theoretical basis, but is insufficient to overcome an overvoltage at said surface required for hydrogen gas generation.

4. The process of claim 1, wherein said applied cathodic potential is sufficient to cause substantial electrochemical decomposition of water.

5. The process of claim 1, wherein the applied cathodic potential is more negative than −100 mV with respect to the corrosion potential of the surface to be protected.

6. The process of claim 1, wherein the applied cathodic potential is in the range of −500 mV to −800 mV with respect to the corrosion potential of the surface to be protected.

7. The process of claim 1, wherein said metal surface forms part of a component of an apparatus, and wherein said component is electrically isolated from a remainder of said apparatus while said cathodic potential is applied.

8. The process of claim 1, wherein cathodic potential is applied constantly.

9. The process of claim 1, wherein said cathodic potential is applied intermittently.

10. The process of claim 9, wherein said cathodic potential is applied in the form of pulses.

11. The process of claim 1, wherein the aqueous solution to which the metal surface is exposed is a solution employed in a Bayer process for extraction of alumina from bauxite.

12. The process of claim 1, wherein said different metal is a ferrous metal and said layer of metal comprises a metal selected from the group consisting of copper, lead, cobalt, silver, gold, rhodium and nickel.

13. The process of claim 1, wherein said cathodic potential is applied at all times during said period of exposure.

14. The process of claim 1, wherein the cathodic potential is held at a predetermined value during said period of exposure.

15. The process of claim 1, wherein said cathodic potential causes a cathodic current to flow from said surface, and said cathodic current is maintained at a predetermined value during said period of exposure.

16. A process of protecting an article, made at least in part of a metal, from scaling, which process comprises applying a layer of a metal different from said metal of said article to form a surface of said different metal, exposing said surface of said metal different from said metal of said article to an alkaline aqueous solution, and applying a cathodic potential to said surface of said different metal during at least some of said exposure to said solution, said cathodic potential being chosen from within a range effective to impart resistance to scaling.

17. The process of claim 16, wherein said article is made from a ferrous metal and said different metal is selected from the group consisting of copper, lead, cobalt, silver, gold, rhodium and nickel.

18. The process of claim 16, wherein said article is made from a ferrous metal and said different metal is copper or an alloy of copper.

19. The process of claim 16, wherein said article is made from a ferrous metal and said different metal is copper.

20. The process of claim 16, wherein said applied cathodic potential is insufficient to cause substantial electrochemical decomposition of water.

21. The process of claim 16, wherein said applied cathodic potential is sufficient to cause decomposition of water on a theoretical basis, but is insufficient to overcome an overvoltage at said surface required for hydrogen gas generation.

22. The process of claim 16, wherein said applied cathodic potential is sufficient to cause substantial electrochemical decomposition of water.

23. The process of claim 16, wherein the applied cathodic potential is more negative than −100 mV with respect to the corrosion potential of the surface to be protected.

24. The process of claim 16, wherein the applied cathodic potential is in the range of −500 mV to −800 mV with respect to the corrosion potential of the surface to be protected.

25. The process of claim 16, wherein said metal surface forms part of a component of an apparatus, and wherein said component is electrically isolated from a remainder of said apparatus while said cathodic potential is applied.

26. The process of claim 16, wherein cathodic potential is applied constantly.

27. The process of claim 16, wherein said cathodic potential is applied intermittently.

28. The process of claim 27, wherein said cathodic potential is applied in the form of pulses.

29. The process of claim 16, wherein the aqueous solution to which the metal surface is exposed is a solution employed in a Bayer process for extraction of alumina from bauxite.

30. The process of claim 16, wherein the cathodic potential is held at a predetermined value during said exposure.

31. The process of claim 16, wherein said cathodic potential causes a cathodic current to flow from said surface, and said cathodic current is maintained at a predetermined value during said exposure.

* * * * *